US011982146B2

(12) United States Patent
Zhang et al.

(10) Patent No.: US 11,982,146 B2
(45) Date of Patent: May 14, 2024

(54) JET FLOW ADJUSTMENT METHOD FOR ROTARY STEERABLE DOWNHOLE RELEASE

(71) Applicants: CHINA NATIONAL PETROLEUM CORPORATION, Beijing (CN); CNPC CHUANQING DRILLING ENGINEERING COMPANY LIMITED, Sichuan (CN)

(72) Inventors: Jichuan Zhang, Sichuan (CN); Dengyun Lu, Sichuan (CN); Jing Bai, Sichuan (CN); Yi Xie, Sichuan (CN); Lei Li, Sichuan (CN); Kexu Chen, Sichuan (CN); Chongjun Huang, Sichuan (CN); Lichun Jia, Sichuan (CN); Dejun Zhang, Sichuan (CN); Zhilin Li, Sichuan (CN); Bin Mao, Sichuan (CN)

(73) Assignees: CHINA NATIONAL PETROLEUM CORPORATION, Beijing (CN); CNPC CHUANQING DRILLING ENGINEERING COMPANY LIMITED, Sichuan (CN)

( * ) Notice: Subject to any disclaimer, the term of this patent is extended or adjusted under 35 U.S.C. 154(b) by 0 days.

(21) Appl. No.: 17/925,605

(22) PCT Filed: May 25, 2021

(86) PCT No.: PCT/CN2021/095725

§ 371 (c)(1),
(2) Date: Nov. 15, 2022

(87) PCT Pub. No.: WO2021/238899

PCT Pub. Date: Dec. 2, 2021

(65) Prior Publication Data

US 2023/0193714 A1 Jun. 22, 2023

(30) Foreign Application Priority Data

May 29, 2020 (CN) ..... 202010473484.7

(51) Int. Cl.

| | |
|---|---|
| ***E21B 7/04*** | (2006.01) |
| ***E21B 21/10*** | (2006.01) |
| ***E21B 31/03*** | (2006.01) |
| ***E21B 34/14*** | (2006.01) |
| ***E21B 37/00*** | (2006.01) |
| ***E21B 41/00*** | (2006.01) |

(52) U.S. Cl.

CPC ..... *E21B 31/03* (2013.01); *E21B 7/04* (2013.01); *E21B 21/103* (2013.01); *E21B 34/14* (2013.01); *E21B 37/00* (2013.01); *E21B 41/0078* (2013.01)

(58) Field of Classification Search

CPC ..... E21B 7/04; E21B 41/0078; E21B 21/103; E21B 37/00

See application file for complete search history.

(56) References Cited

U.S. PATENT DOCUMENTS

2015/0136490 A1* 5/2015 Broussard, Jr. ..... E21B 10/02 175/57
2020/0308919 A1* 10/2020 Solem ..... E21B 21/103

* cited by examiner

*Primary Examiner* — Catherine Loikith

(57) ABSTRACT

A jet flow adjustment method for rotary steerable downhole release includes steps of: defining a diversion ratio p of a jet nozzle by a ground control system; and sending the diversion ratio p of the jet nozzle to a control unit of a downhole rotary steerable system; and determining an opening areas of the jet nozzle by the control unit according to the diversion ratio p of the jet nozzle and an equivalent channel area S of a drilling tool; controlling an adjustable bypass valve by the control unit of the downhole rotary steerable system according to the calculated opening area s of the jet nozzle, so as to control an overlapping area between sector holes of a rotor end and a stator end, thereby opening the jet nozzle for release. The present invention has simple control and strong release ability.

12 Claims, 4 Drawing Sheets

JET FLOW ADJUSTMENT METHOD FOR ROTARY STEERABLE DOWNHOLE RELEASE

BACKGROUND OF THE PRESENT INVENTION

Field of Invention

The present invention relates to a technical field of downhole drilling equipment for oil wells, and more particularly to a jet flow adjustment method for rotary steerable downhole release.

Description of Related Arts

Water-sensitive strata such as loose layers, clay, mudstone and shale may be encountered during a drilling process. In such strata, problems such as expansion, shrinkage and spalling are very likely to occur when encountering water, which seriously threatens the drilling tools in the well. During the drilling process in such strata, improper use of slurry, sudden power failure or circulation failure of slurry can easily cause jamming. Therefore, when drilling in such strata, the most common problem is jamming accidents.

With the continuous development of shale gas exploration, extended reach wells and horizontal wells, especially three-dimensional cluster horizontal wells, have increased substantially in the Sichuan-Chongqing area of China, wherein 90% of the horizontal wells deployed for shale gas are three-dimensional horizontal wells, and the horizontal segment is getting longer and longer. During horizontal well drilling, it is common to face problems such as large borehole friction and downhole tool jamming, which greatly lowers the time-effectiveness of exploration and development.

Chinese patent CN104863503B, "Anti jamming drilling device based on double-wall drill pipe and downhole power drilling tool", was published on Mar. 1, 2017 by China National Intellectual Property Administration, which includes a plurality of double-wall drill pipes arranged in series. A rotary jet desander is connected between adjacent double-wall drill pipes. A bottom end of the last double-wall drill pipe is connected to a conversion joint, and a bottom end of the conversion joint is connected to a downhole power drilling tool. According to the patent, the rotary jet desander and the single and double-wall drill pipe conversion joint are applied to a drill string, which can increase the drilling fluid flow rate in an outer annular overflow channel between an external pipe of the double-wall drill pipe and a well wall, so as to reduce deposition of solid phase particles, reduce and contract the filter cakes deposited on the well wall, and effectively prevent the jamming accidents.

The above prior art disclosed a jet nozzle on the drill string. The jet nozzle can effectively prevent the jamming accidents. However, the above prior art can only play a preventive role, and the release ability thereof is poor when the jamming accident occurs.

SUMMARY OF THE PRESENT INVENTION

In order to overcome the above-mentioned defects and deficiencies in the prior art, the present invention provides a jet flow adjustment method for rotary steerable downhole release. An object of the present invention is to improve the poor release ability of the prior art, which is realized by providing a jet nozzle with an adjustable area on a drill string of a rotary steerable downhole equipment. When engineering and technical personnel finds that the downhole cuttings bed is seriously piled up, an instruction can be issued to clarify a diversion ratio of the jet nozzle, set an equivalent channel area of the drilling tool, and calculate an opening area of the jet nozzle. As a result, a part of the drilling fluid passes through the jet nozzle and form a rotating jet flow through rotation of the drill string, thereby breaking surrounding cuttings bed to release the rotary steerable tool. The present invention has simple control and strong release ability, which can effectively solve the jamming problem of the rotary steerable downhole tool.

Accordingly, in order to accomplish the above objects, the present invention provides:

a jet flow adjustment method for rotary steerable downhole release, comprising steps of:

defining a diversion ratio p of a jet nozzle by a ground control system according to a cleaning requirement of a cuttings bed; and sending the diversion ratio p of the jet nozzle to a control unit of a downhole rotary steerable system; and determining an opening area s of the jet nozzle by the control unit of the downhole rotary steerable system according to the diversion ratio p of the jet nozzle and an equivalent channel area S of a drilling tool, wherein a calculation formula is: $s=p*S/(1-p)$; controlling an adjustable bypass valve by the control unit of the downhole rotary steerable system according to the calculated opening area s of the jet nozzle, so as to control an overlapping area between sector holes of a rotor end and a stator end, thereby opening the jet nozzle; after cleaning, waiting for the ground control system to close the jet nozzle.

According to a downhole accumulation state of the cuttings bed, the ground control system performs a rough classification based on a ground friction torque, and sets three diversion ratios which are 20%, 40% and 60%. A higher diversion ratio is suitable for a more serious cuttings bed, which uses a larger friction torque.

The equivalent channel area of the drilling tool is a constant parameter known before the drilling tool enters the well. The calculation is done on the control unit of the downhole rotary steerable system. According to the required diversion ratio, the opening area of the jet nozzle is calculated. Based on the relationship between the open area of the jet nozzle and a relative angle of rotor and stator (this relationship is an inherent attribute and can be calibrated in the laboratory), a motor drives the rotor to a set position.

According to the required diversion ratio, the opening area of the jet nozzle is calculated. Based on the relationship between the open area of the jet nozzle and the relative angle of rotor and stator (this relationship is an inherent attribute and can be calibrated in the laboratory), the motor drives the rotor to the set position.

There is a lower limit for the flow rate, because a low jet flow rate cannot sufficiently break the cuttings bed. On a drill collar, there is a requirement for the opening area, which is determined according to Bernoulli's equation. At the minimum required diversion ratio, the jet flow rate should be at least 30 m/s, and the opening area should be larger than the opened sector area between the rotor end and the stator end. In the present invention, it is only necessary to control the opening area since the opening area itself determines the diversion ratio that determines the jet flow rate. There is no requirement for the medium.

The jet nozzle is tilted towards a drill bit, and an exit angle of the jet nozzle is 30°-45°.

The adjustable bypass valve comprises a drive motor, the rotor end and the stator end, wherein an output shaft of the drive motor is connected to the rotor end; the sector holes are drilled on both the rotor end and the stator end; the drive motor drives the rotor end to rotate relative to the stator end, thereby changing the overlapping area between the sector holes of the rotor end and the stator end to open and close the jet nozzle.

The adjustable bypass valve further comprises an external cylinder arranged in the jet nozzle, wherein the drive motor is fixed on an internal wall of the external cylinder by a motor support plate, and the stator end is also fixed on the internal wall of the external cylinder.

A bypass hole is drilled on a side wall of the external cylinder; a through hole is drilled on the stator end to communicate with the bypass hole; and a connecting hole is drilled on the rotor end to communicate with the through hole of the stator end.

Compared with the prior art, beneficial effects of the present invention are as follows:

1. The present invention designs the jet nozzle with the adjustable area on the drill string of the rotary steerable downhole equipment. When engineering and technical personnel finds that the downhole cuttings bed is seriously piled up, an instruction can be issued to open the bypass valve of the jet nozzle. As a result, a part of the drilling fluid passes through the jet nozzle and form a rotating jet flow through rotation of the drill string, thereby breaking surrounding cuttings bed to release the rotary steerable tool. The present invention has simple control and strong release ability, which can effectively solve the jamming problem of the rotary steerable downhole tool.

2. The adjustable jet nozzle consists of a rotor part and a stator part, wherein the rotor end and the stator end are both wear-resistant alloy sector columns. By rotating the rotor, the overlapping area of the two sector holes is changed, so as to adjust the opening area of the jet nozzle and form different jet flows, thereby meeting the cleaning needs of different cuttings beds. The rotational power of the rotor is electronically controlled.

3. Compared with drill string cyclone desander, the present invention can adjust the jet flow, which provides different types of jet flows under different requirements, so as to realize an optimal removal effect. The rotor end and the stator end of the adjustable jet nozzle is designed according to requirements, wherein a maximum flow area of the rotor end and the stator end is comprehensively designed according to a strength of the drilling tool and a jet effect, which is equivalent to an area of a through hole on the drill string. The exit angle of the jet nozzle is 30-45°, which is preferably tilted to the drill bit.

Figure 1:
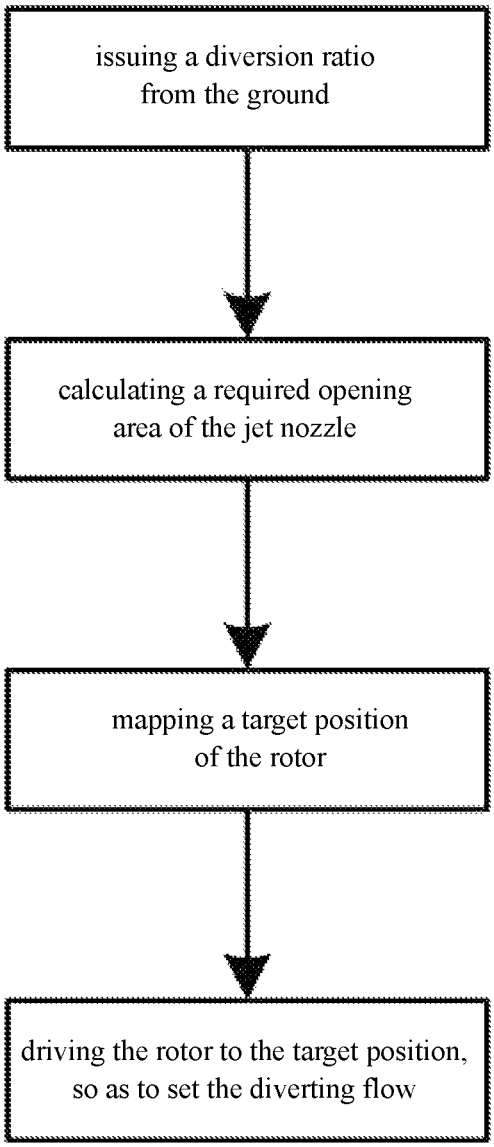
FIG. 1 is a flow chart of a jet flow adjustment method of the present invention.
Figure 2:
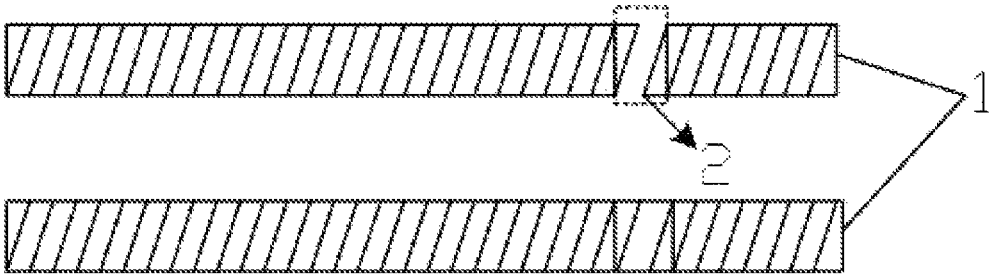
FIG. 2 is a structural view of a drill string of jet flow adjustment of the present invention.
Figure 3:
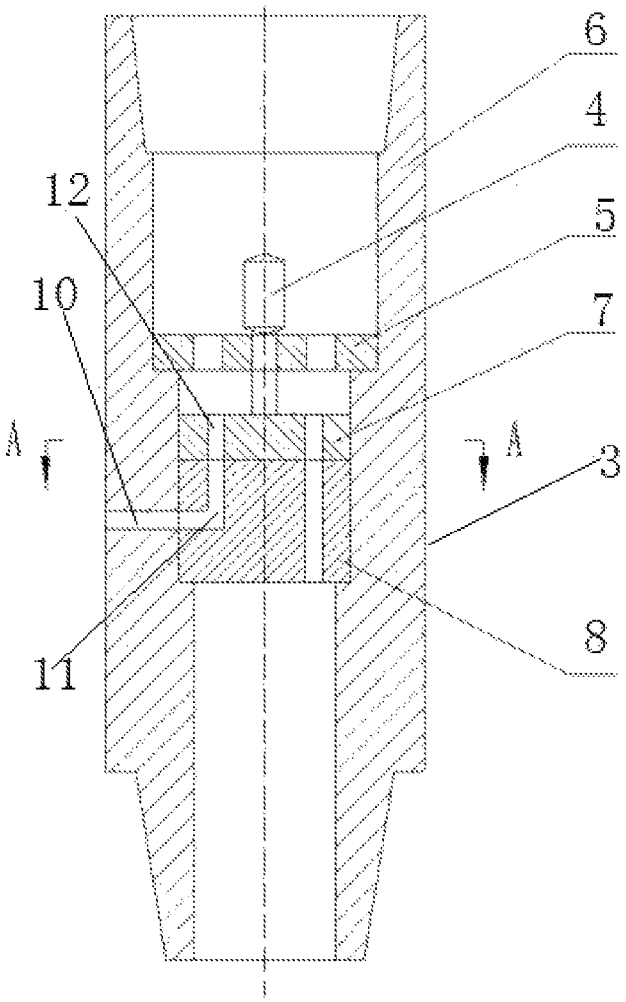
FIG. 3 is a structural view of an adjustable bypass valve of the present invention.
Figure 4:
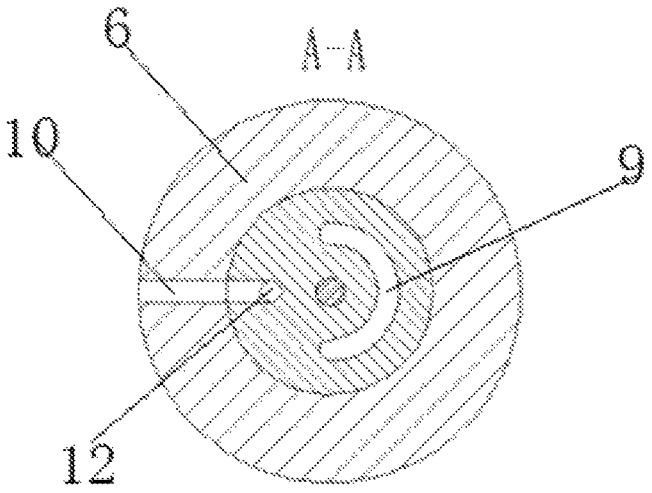
FIG. 4 is an A-A sectional view of FIG. 3 of the present invention.

Element reference: 1-drill string, 2-jet nozzle, 3-adjustable bypass valve, 4-drive motor, 5-motor support plate, 6-external cylinder, 7-rotor end, 8-stator end, 9-sector hole, 10-bypass hole, 11-through hole, 12-connecting hole.

DETAILED DESCRIPTION OF THE PREFERRED EMBODIMENT

Referring to the drawings, present invention will be further illustrated.

Embodiment 1

As a preferred embodiment of the present invention, referring to FIG. 1, the embodiment 1 provides:

a jet flow adjustment method for rotary steerable downhole release, comprising steps of:

defining a diversion ratio p of a jet nozzle 2 by a ground control system according to a cleaning requirement of a cuttings bed; and sending the diversion ratio p of the jet nozzle 2 to a control unit of a downhole rotary steerable system; and determining an opening area s of the jet nozzle 2 by the control unit of the downhole rotary steerable system according to the diversion ratio p of the jet nozzle 2 and an equivalent channel area S of a drilling tool, wherein a calculation formula is: $s=p*S/(1-p)$; controlling an adjustable bypass valve 3 by the control unit of the downhole rotary steerable system according to the calculated opening area s of the jet nozzle 2, so as to control an overlapping area between sector holes 9 of a rotor end 7 and a stator end 8, thereby opening the jet nozzle 2; after cleaning, waiting for the ground control system to close the jet nozzle 2.

According to a downhole accumulation state of the cuttings bed, the ground control system performs a rough classification based on a ground friction torque, and sets three diversion ratios which are 20%, 40% and 60%. A higher diversion ratio is suitable for a more serious cuttings bed, which uses a larger friction torque. The equivalent channel area of the drilling tool is a constant parameter known before the drilling tool enters the well. The calculation is done on the control unit of the downhole rotary steerable system. According to the required diversion ratio, the opening area of the jet nozzle 2 is calculated. Based on the relationship between the open area of the jet nozzle 2 and a relative angle of rotor and stator (this relationship is an inherent attribute and can be calibrated in the laboratory), a motor drives the rotor to a set position.

According to the required diversion ratio, the opening area of the jet nozzle 2 is calculated. Based on the relationship between the open area of the jet nozzle 2 and the relative angle of rotor and stator (this relationship is an inherent attribute and can be calibrated in the laboratory), the motor drives the rotor to the set position. There is a lower limit for the flow rate, because a low jet flow rate cannot sufficiently break the cuttings bed. On a drill collar, there is a requirement for the opening area, which is determined according to Bernoulli's equation. At the minimum required diversion ratio, the jet flow rate should be at least 30 m/s, and the opening area should be larger than the opened sector area between the rotor end and the stator end. In the present invention, it is only necessary to control the opening area since the opening area itself determines the diversion ratio that determines the jet flow rate. There is no requirement for the medium.

Embodiment 2

As another preferred embodiment of the present invention, referring to FIGS. 1-4, the embodiment 2 provides:

a jet flow adjustment method for rotary steerable downhole release, comprising steps of:

defining a diversion ratio p of a jet nozzle 2 by a ground control system according to a cleaning requirement of a cuttings bed; and sending the diversion ratio p of the jet nozzle 2 to a control unit of a downhole rotary steerable system; and determining an opening area s of the jet nozzle 2 by the control unit of the downhole rotary steerable system according to the diversion ratio p of the jet nozzle 2 and an equivalent channel area S of a drilling tool, wherein a calculation formula is: $s=p*S/(1-p)$; controlling an adjustable bypass valve 3 by the control unit of the downhole rotary steerable system according to the calculated opening area s of the jet nozzle 2, so as to control an overlapping area between sector holes 9 of a rotor end 7 and a stator end 8, thereby opening the jet nozzle 2; after cleaning, waiting for the ground control system to close the jet nozzle 2. According to a downhole accumulation state of the cuttings bed, the ground control system performs a rough classification based on a ground friction torque, and sets three diversion ratios which are 20%, 40% and 60%. A higher diversion ratio is suitable for a more serious cuttings bed, which uses a larger friction torque. The equivalent channel area of the drilling tool is a constant parameter known before the drilling tool enters the well. The calculation is done on the control unit of the downhole rotary steerable system. According to the required diversion ratio, the opening area of the jet nozzle 2 is calculated. Based on the relationship between the open area of the jet nozzle 2 and a relative angle of rotor and stator (this relationship is an inherent attribute and can be calibrated in the laboratory), a motor drives the rotor to a set position. According to the required diversion ratio, the opening area of the jet nozzle 2 is calculated. Based on the relationship between the open area of the jet nozzle 2 and the relative angle of rotor and stator (this relationship is an inherent attribute and can be calibrated in the laboratory), the motor drives the rotor to the set position. There is a lower limit for the flow rate, because a low jet flow rate cannot sufficiently break the cuttings bed. On a drill collar, there is a requirement for the opening area, which is determined according to Bernoulli's equation. At the minimum required diversion ratio, the jet flow rate should be at least 30 m/s, and the opening area should be larger than the opened sector area between the rotor end and the stator end. In the present invention, it is only necessary to control the opening area since the opening area itself determines the diversion ratio that determines the jet flow rate. There is no requirement for the medium.

The jet nozzle 2 is arranged on a drill string 1 and is tilted towards a drill bit, and an exit angle of the jet nozzle 2 is 30°-45°. The adjustable bypass valve 3 comprises a drive motor 4, the rotor end 7 and the stator end 8, wherein an output shaft of the drive motor 4 is connected to the rotor end 7; the sector holes 9 are drilled on both the rotor end 7 and the stator end 8; the drive motor 4 drives the rotor end 7 to rotate relative to the stator end 8, thereby changing the overlapping area between the sector holes 9 of the rotor end 7 and the stator end 8 to open and close the jet nozzle 2.

Embodiment 3

As yet another preferred embodiment of the present invention, referring to FIGS. 1-4, the embodiment 3 provides:

a jet flow adjustment method for rotary steerable downhole release, comprising steps of:

defining a diversion ratio p of a jet nozzle 2 by a ground control system according to a cleaning requirement of a cuttings bed; and sending the diversion ratio p of the jet nozzle 2 to a control unit of a downhole rotary steerable system; and determining an opening area s of the jet nozzle 2 by the control unit of the downhole rotary steerable system according to the diversion ratio p of the jet nozzle 2 and an equivalent channel area S of a drilling tool, wherein a calculation formula is: $s=p*S/(1-p)$; controlling an adjustable bypass valve 3 by the control unit of the downhole rotary steerable system according to the calculated opening area s of the jet nozzle 2, so as to control an overlapping area between sector holes 9 of a rotor end 7 and a stator end 8, thereby opening the jet nozzle 2; after cleaning, waiting for the ground control system to close the jet nozzle 2. According to a downhole accumulation state of the cuttings bed, the ground control system performs a rough classification based on a ground friction torque, and sets three diversion ratios which are 20%, 40% and 60%. A higher diversion ratio is suitable for a more serious cuttings bed, which uses a larger friction torque. The equivalent channel area of the drilling tool is a constant parameter known before the drilling tool enters the well. The calculation is done on the control unit of the downhole rotary steerable system. According to the required diversion ratio, the opening area of the jet nozzle 2 is calculated. Based on the relationship between the open area of the jet nozzle 2 and a relative angle of rotor and stator (this relationship is an inherent attribute and can be calibrated in the laboratory), a motor drives the rotor to a set position. According to the required diversion ratio, the opening area of the jet nozzle 2 is calculated. Based on the relationship between the open area of the jet nozzle 2 and the relative angle of rotor and stator (this relationship is an inherent attribute and can be calibrated in the laboratory), the motor drives the rotor to the set position. There is a lower limit for the flow rate, because a low jet flow rate cannot sufficiently break the cuttings bed. On a drill collar, there is a requirement for the opening area, which is determined according to Bernoulli's equation. At the minimum required diversion ratio, the jet flow rate should be at least 30 m/s, and the opening area should be larger than the opened sector area between the rotor end and the stator end. In the present invention, it is only necessary to control the opening area since the opening area itself determines the diversion ratio that determines the jet flow rate. There is no requirement for the medium.

The jet nozzle 2 is arranged on a drill string 1 and is tilted towards a drill bit, and an exit angle of the jet nozzle 2 is 30°-45°. The adjustable bypass valve 3 comprises a drive motor 4, the rotor end 7 and the stator end 8, wherein an output shaft of the drive motor 4 is connected to the rotor end 7; the sector holes 9 are drilled on both the rotor end 7 and the stator end 8; the drive motor 4 drives the rotor end 7 to rotate relative to the stator end 8, thereby changing the overlapping area between the sector holes 9 of the rotor end 7 and the stator end 8 to open and close the jet nozzle 2.

The adjustable bypass valve 3 further comprises an external cylinder 6 arranged in the jet nozzle 2, wherein the drive motor 4 is fixed on an internal wall of the external cylinder 6 by a motor support plate 5, and the stator end 8 is also fixed on the internal wall of the external cylinder 6. A bypass hole 10 is drilled on a side wall of the external cylinder 6; a through hole 11 is drilled on the stator end 8 to communicate with the bypass hole 10; and a connecting hole 12 is drilled on the rotor end 7 to communicate with the through hole 11 of the stator end 8.

What is claimed is:

1. A jet flow adjustment method, comprising steps of:

defining a diversion ratio (p) of a jet nozzle (2) by a ground control system according to a cleaning requirement of a cuttings bed;

sending the diversion ratio (p) of the jet nozzle (2) to a control unit of a downhole rotary steerable system;

determining an opening area (s) of the jet nozzle (2) by the control unit of the downhole rotary steerable system according to the diversion ratio (p) of the jet nozzle (2) and an equivalent channel area (S) of a drilling tool, wherein a calculation formula is:

$$s=p*S/(1-p);$$

controlling an adjustable bypass valve (3) by the control unit of the downhole rotary steerable system according to the opening area (s) of the jet nozzle (2), so as to control an overlapping area between sector holes (9) of a rotor end (7) and a stator end (8), thereby opening the jet nozzle (2); and waiting for the ground control system to close the jet nozzle (2);

wherein the adjustable bypass valve (3) comprises a drive motor (4), the rotor end (7) and the stator end (8), wherein an output shaft of the drive motor (4) is connected to the rotor end (7); the sector holes (9) are drilled on both the rotor end (7) and the stator end (8); the drive motor (4) drives the rotor end (7) to rotate relative to the stator end (8), thereby changing the overlapping area between the sector holes (9) of the rotor end (7) and the stator end (8) to open and close the jet nozzle (2).

2. The jet flow adjustment method, as recited in claim 1, wherein according to a downhole accumulation state of the cuttings bed, the ground control system performs a rough classification based on a ground friction torque, and sets three diversion ratios which are 20%, 40% and 60%.

3. The jet flow adjustment method, as recited in claim 1, wherein the jet nozzle (2) is arranged on a drill string (1) and is tilted towards a drill bit, and an exit angle of the jet nozzle (2) is 30°-45°.

4. The jet flow adjustment method, as recited in claim 3, wherein the jet nozzle (2) is arranged on the drill string (1) and is tilted towards the drill bit, and the exit angle of the jet nozzle (2) is 30°.

5. The jet flow adjustment method, as recited in claim 3, wherein the jet nozzle (2) is arranged on the drill string (1) and is tilted towards the drill bit, and the exit angle of the jet nozzle (2) is 45°.

6. The jet flow adjustment method, as recited in claim 1, wherein the adjustable bypass valve (3) further comprises an external cylinder (6) arranged in the jet nozzle (2).

7. The jet flow adjustment method, as recited in claim 6, wherein the drive motor (4) is fixed on an internal wall of the external cylinder (6) by a motor support plate (5), and the stator end (8) is also fixed on the internal wall of the external cylinder (6).

8. The jet flow adjustment method, as recited in claim 6, wherein a bypass hole (10) is drilled on a side wall of the external cylinder (6); and a through hole (11) is drilled on the stator end (8) to communicate with the bypass hole (10).

9. The jet flow adjustment method, as recited in claim 8, wherein a connecting hole is drilled on the rotor end (7) to communicate with the through hole (11) of the stator end (8).

10. The jet flow adjustment method, as recited in claim 1, wherein the equivalent channel area of the drilling tool is a constant parameter known before the drilling tool enters a well.

11. The jet flow adjustment method, as recited in claim 10, wherein calculation of the constant parameter is done in the control unit of the downhole rotary steerable system; according to the diversion ratio, the opening area of the jet nozzle is calculated; based on a relationship between the open area of the jet nozzle and a relative angle of a rotor and a stator, the drive motor drives the rotor to a set position.

12. The jet flow adjustment method, as recited in claim 1, wherein the rotor end and the stator end are both wear-resistant alloy sector columns.

* * * * *